US006092455A

United States Patent [19]

Endsley et al.

[11] Patent Number: 6,092,455

[45] Date of Patent: Jul. 25, 2000

[54] HYDRAULIC PRESSURE TRANSFORMER

[75] Inventors: John C. Endsley, Washington; David C. Hale; Frank J. Raab, both of Chillicothe, all of Ill.

[73] Assignee: Caterpillar Inc., Peoria, Ill.

[21] Appl. No.: 09/187,388

[22] Filed: Nov. 6, 1998

[51] Int. Cl.[7] ..... F01B 3/00

[52] U.S. Cl. ..... 92/71; 92/12.2; 92/31; 91/6.5; 91/491; 91/499; 91/505; 417/270; 417/269; 417/271

[58] Field of Search ..... 92/12.2, 71, 31; 91/491, 6.5, 499, 505; 417/270, 457, 269, 282, 440, 271; 123/56.9; 474/28; 60/469, 468, 435

[56] References Cited

U.S. PATENT DOCUMENTS

| | | | |
|---|---|---|---|
| 3,625,253 | 12/1991 | Christiansen . | |
| 3,627,451 | 12/1971 | Kouns | 417/271 |
| 3,967,541 | 7/1976 | Born et al. | 92/12.2 |
| 4,048,906 | 9/1977 | Firth et al. | 91/491 |
| 4,401,415 | 8/1983 | Hammelmann | 417/270 |
| 4,418,656 | 12/1983 | Stanton | 123/56.9 |
| 4,540,345 | 9/1985 | Frazer | 417/269 |
| 4,825,753 | 5/1989 | Inoue et al. | 92/12.2 |
| 4,945,817 | 8/1990 | Scholl | 91/505 |
| 5,308,287 | 5/1994 | Gunsing | 474/28 |
| 5,555,726 | 9/1996 | Huebner | 80/469 |
| 5,904,043 | 5/1999 | Nagatomo | 60/435 |

FOREIGN PATENT DOCUMENTS

| | | |
|---|---|---|
| 1653509 | 12/1970 | Germany . |
| 4321770 | 9/1994 | Germany . |
| 957326 | 5/1964 | United Kingdom . |
| WO 97/31185 | 8/1997 | WIPO . |

*Primary Examiner*—Teresa Walberg
*Assistant Examiner*—Leonid Fastovsky
*Attorney, Agent, or Firm*—Todd Taylor

[57] ABSTRACT

A hydraulic pressure transformer for the conversion of an input hydraulic power to an output hydraulic power includes a housing with a generally planar face surface and a plurality of ports opening at the face surface. A barrel which is rotatable about an axis includes a generally spherical end face and a plurality of cylinders opening at the end face. A port block interposed between the barrel and the housing is rotatable about the axis. The port block has a first face surface, a second face surface and a plurality of ports extending between the first face surface and the second face surface. The ports selectively fluidly interconnect the plurality of cylinders in the barrel with the plurality of ports in the housing. The first face surface is generally spherical and abuts the end face of the barrel. The second face surface is generally planar and abuts the face surface of the housing.

11 Claims, 2 Drawing Sheets

HYDRAULIC PRESSURE TRANSFORMER

TECHNICAL FIELD

The present invention relates to hydraulic pressure transformers, and, more particularly, to hydraulic pressure transformers having a movable port block interposed between an end cap and a rotating barrel.

BACKGROUND ART

Hydraulic pressure transformers are used to transform an input flow of hydraulic fluid at a first flow rate and pressure to an output flow of hydraulic fluid at a second flow rate and pressure. The output flow rate and pressure are variable to provide a variable output flow to a specific application, such as a hydrostatic transmission.

Conventional hydraulic pressure transformers may include a housing with a rotatable barrel and a movable port plate disposed therein. The port plate includes three arcuate slots which selectively interconnect a plurality of ports in the housing with a plurality of cylinders in the barrel upon rotation of the barrel during use. The relative position between the slots in the port plate and the ports in the housing define the output pressure from the hydraulic pressure transformer.

It is also known to provide a hydraulic pressure transformer with a port block instead of a port plate between the housing and barrel. The port block includes a spherical surface on each end thereof which abuts a complimentary spherical surface on the housing and barrel, respectively. The spherical surfaces at each end of the port block allow slight tipping or tilting between the housing, port block and barrel, while at the same time maintaining a substantially sealed relationship therebetween. Although effective to provide a substantially sealed contact between the abutting surfaces, the spherical surfaces at each end of the port block are relatively expensive to manufacture.

A port block as described above is typically rotatably carried within the housing by a pair of large diameter roller bearings which are seated within the housing and radially surround a port block. Both the housing and the port block are usually formed with stepped annular surfaces which are used to properly seat the roller bearing assemblies relative to each of the housing and the port block. The roller bearing assemblies, as well as the stepped annular shoulders which are formed to receive the bearing assemblies, increase the manufacturing complexity and cost of the hydraulic pressure transformer. A port block as described can experience a significant tipping moment as the various ports are exposed to varying pressure. The large diameter rolling element bearings are required to carry the moments and prevent tipping of the port plate.

The present invention is directed to overcoming one or more of the problems as set forth above.

DISCLOSURE OF THE INVENTION

The present invention provides a hydraulic pressure transformer with a movable port block having a spherical face surface abutting a complementary spherical end face on the barrel and a planar face surface abutting a complementary planar face surface on the end cap. The port block may have a plurality of hydraulic pressure pads defining a hydrostatic bearing between the port block and the end cap.

In one aspect of the invention, a hydraulic pressure transformer for the conversion of an input hydraulic power to an output hydraulic power includes a housing with a generally planar face surface and a plurality of ports opening at the face surface. A barrel which is rotatable about an axis includes a generally spherical end face and a plurality of cylinders opening at the end face. A port block interposed between the barrel and the housing is rotatable about the axis. The port block has a first face surface, a second face surface and a plurality of ports extending between the first face surface and the second face surface. The ports selectively fluidly interconnect the plurality of cylinders in the barrel with the plurality of ports in the housing. The first face surface is generally spherical and abuts the end face of the barrel. The second face surface is generally planar and abuts the face surface of the housing.

An advantage of the present invention is that the port block includes only one spherical face surface, with the other face surface being planar and thereby reducing manufacturing complexity and costs.

Another advantage is that the port block may be carried by a hydrostatic bearing within the end cap using pressurized hydraulic fluid from the ports within the port block. Proper sizing and location of these hydrostatic loads will overcome the tipping moments on the port block.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

BEST MODE FOR CARRYING OUT THE INVENTION

Figure 1:
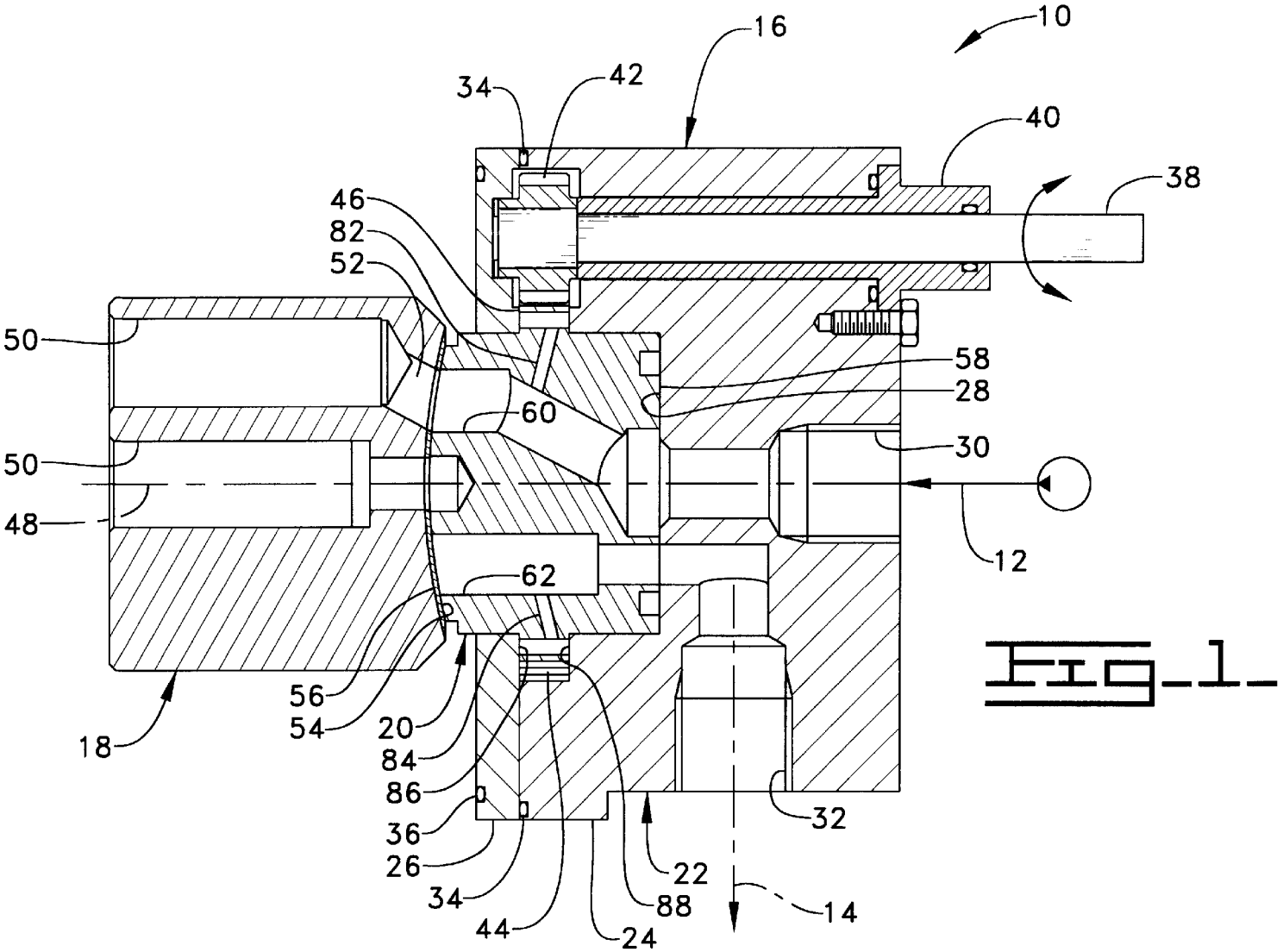
FIG. 1 is a side sectional view of a portion of an embodiment of a hydraulic pressure transformer of the present invention.
Figure 2:
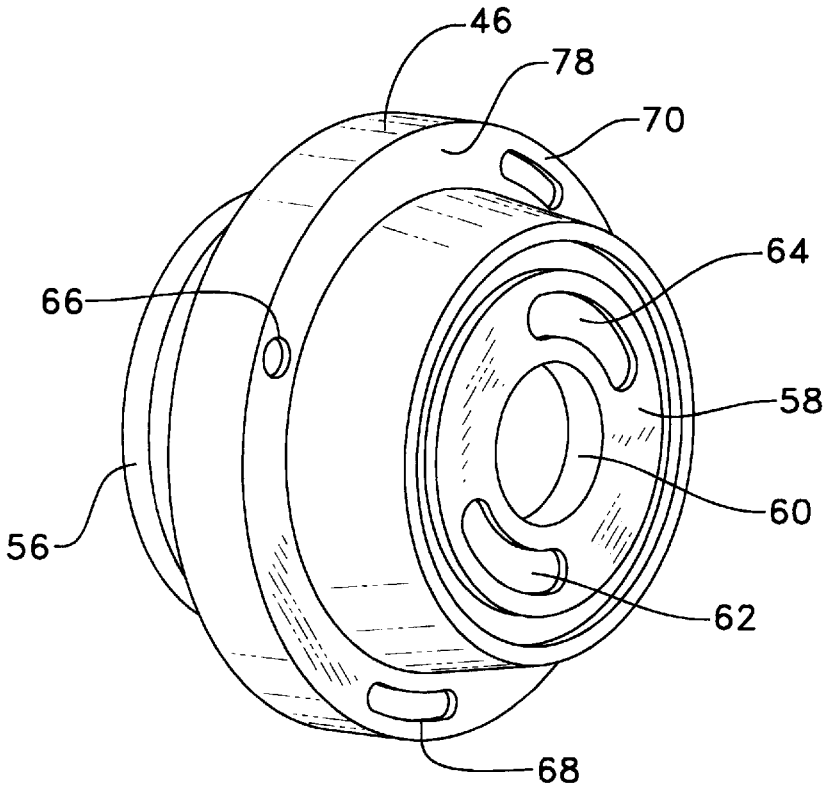
FIG. 2 is a perspective view of the port block shown in FIG. 1.
Figure 3:
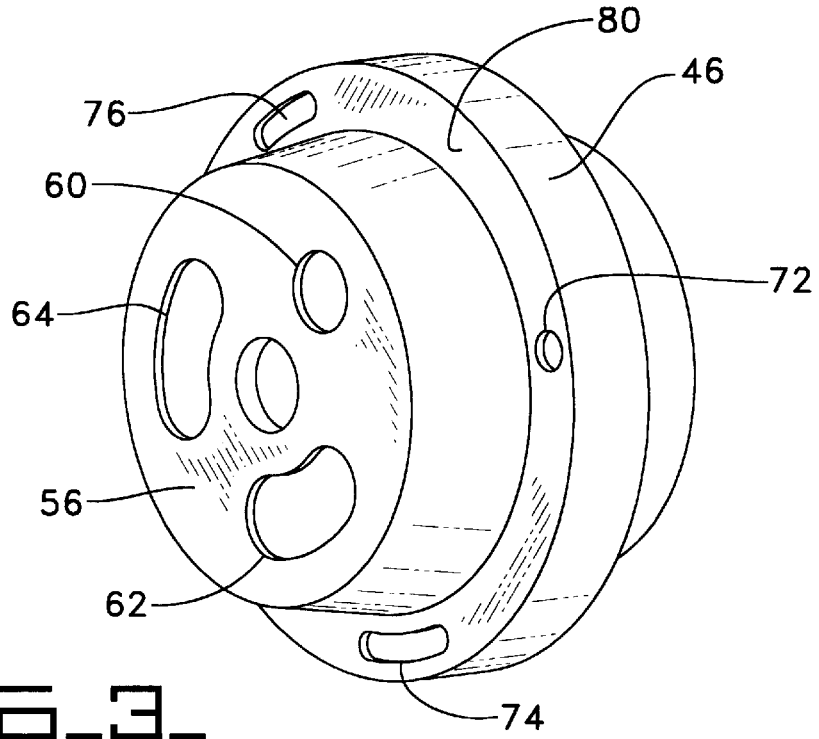
FIG. 3 is another perspective view of the port block shown in FIG. 1.

Referring now to the drawings, and more particularly to FIG. 1, there is shown an embodiment of a portion of a hydraulic pressure transformer 10 of the present invention for converting an input hydraulic power at a first fluid flow and first fluid pressure (indicated schematically at line 12) to an output hydraulic power at a second fluid flow and second fluid pressure (indicated schematically at line 14). Hydraulic pressure transformer 10 generally includes a housing 16, barrel 18 and port block 20.

Housing 16 includes a two-piece end cap 22 with a first piece 24 and a second piece 26. The housing 16 could be of any number of pieces without changing the essence of the invention. First piece 24 of end cap 22 includes a generally planar face surface 28 against which port block 20 abuts, as will be described in further detail hereinafter. First piece 24 of end cap 22 also includes a plurality of ports 30 and 32 which open at planar face surface 28. Port 30, in the embodiment shown, is in the form of an inlet port which receives pressurized hydraulic fluid from a suitable source of pressurized hydraulic fluid 12. Port 32, in the embodiment shown, is in the form of an outlet port providing an outlet flow to a desired application, indicated schematically at 14. First piece 24 of end cap 22 also includes a third port (not shown) which is fluidly connected with a source of low pressure hydraulic fluid to allow the cylinders within barrel 18 to fill with hydraulic fluid during a portion of the expansion stroke of the pistons carried thereby, in known manner.

First piece 24 and second piece 26 of end cap 22 are connected together using suitable fastening devices, such as bolts (not shown). An O-ring 34 provides a substantially fluid-tight seal between first piece 24 and second piece 26. A second O-ring 36 allows end cap 22 to be connected with another portion (not shown) of housing 16 which surrounds barrel 18 in a substantially fluid-tight manner. A drive shaft 38 which is rotatably carried within end cap 22 using a reduced friction bearing such as bushing 40 includes external teeth 42 which engage and drive corresponding external teeth 44 on an annular flange 46 of port block 20.

Barrel 18 is rotatable about an axis 48 and includes a plurality of cylinders 50 with respective cylinder ports 52 which open at a generally spherical end face 54. Barrel 18 also includes a third cylinder (not shown) with a corresponding cylinder port which also opens at spherical end face 54. A plurality of pistons (not shown) are reciprocally disposed within corresponding cylinders 50 in known manner. Spherical end face 54 allows some degree of tilting between barrel 18 and port block 20 as a result of pressure differentials within cylinder ports 52, while at the same time maintaining a substantially fluid-tight seal between barrel 18 and port block 20.

Port block 20 is interposed between barrel 18 and housing 16 and is rotatable about axis 48. Port block 20 includes a first face surface 56, a second face surface 58 and a plurality of ports 60, 62 and 64 which extend between first face surface 56 and second face surface 58. Ports 60, 62 and 64 selectively fluidly interconnect the plurality of cylinder ports 52 in barrel 18 with the plurality of ports 30 and 32 in end cap 22 during rotation of barrel 18.

First face surface 56 is generally spherical and provides a substantially fluid-tight abutment between barrel 18 and port block 20 upon slight tipping between barrel 18 and port block 20 during rotation of barrel 18. Second face surface 58, in contrast with conventional port block designs, is a generally flat surface which abuts a corresponding flat face surface 28 of end cap 22. By providing second face surface 58 with a generally flat surface, port block 20 may be more easily manufactured and manufacturing costs are reduced. In this application the annular flange 46 is interposed the planar face surface 28 and the first face surface 56. As an alternative the flange 46 could extend the entire distance between the planar face surface 28 and the first face surface 56. Additionally, the second face surface 58 and the planar face surface 28 could be spherical as well as being flat as is shown in this application.

Port block 20 is carried within end cap 22 with a hydrostatic bearing which allows port block 22 to easily move relative to end cap 22 while at the same time preventing tipping or tilting while providing force balancing therebetween. With conventional designs, port block 20 is rotatably carried within a pair of large diameter roller bearing assemblies which are seated within end cap 22. By providing a hydrostatic bearing, rather than a pair of roller bearing assemblies, additional machining on port block 20 and end cap 22, as well as the additional pair of ball bearing assemblies, are eliminated, thus further reducing the manufacturing complexity and costs of hydraulic pressure transformer 10. More particularly, annular flange 46 of port block 20 is concentrically disposed around axis 48 between first face surface 56 and second face surface 58. Flange 46 includes a plurality of hydraulic pressure pads which are fluidly connected with a corresponding port 60, 62 or 64 in port block 20. In the embodiment shown, flange 46 includes six hydraulic pressure pads with hydraulic pads 66, 68 and 70 being located in a shoulder 78 facing toward second face surface 58, and hydraulic pressure pads 72, 74 and 76 being located in a shoulder 80 facing toward first face surface 56. As an alternative, any number of a plurality of pressure pads could be used without changing the jest of the invention. Hydraulic pressure pads 66 and 72 are commonly connected via a branch channel 82 with port 60 in port block 20. Similarly, hydraulic pressure pads 68 and 74 are commonly connected via a branch channel 84 with port 62 in port block 20. Hydraulic pressure pads 70 and 76 are also connected via a common branch channel (not shown) with port 64 in port block 20.

First piece 24 and second piece 26 of end cap 22 define respective reaction surfaces 86 and 88 which are located adjacent to hydraulic pressure pads 66, 68, 70, 72, 74 and 76. As will be appreciated, the fluid pressure which is applied against the reaction surfaces 86 and 88 occurs in opposite directions and therefore neutralizes the moment and pressure balance on the port block 20, and facilitates a hydrostatic bearing. The pressure of the fluid exerted against reaction surfaces 86 and 88 is effective to create a thin boundary layer of fluid between port block 20 and end cap 22, thereby resulting in the formation of a hydrostatic bearing therebetween. Port block 20 may thus be relatively easily rotatably moved within end cap 22.

INDUSTRIAL APPLICABILITY

In use, hydraulic pressure transformer 10 receives pressurized hydraulic fluid at inlet port 30. The pressurized hydraulic fluid is coupled with a cylinder 50 in barrel 18 through port 60 in port block 20, thereby exerting an axial force on the piston located within the cylinder 50 and causing rotation of barrel 18 about axis 48. The stroke length of the pistons disposed within the plurality of cylinders 50 can be adjusted using a known displacement control plate, thereby adjusting the volumetric flow rate from outlet port 32 in end cap 22. The position of port block 20 relative to ports 30 and 32 in end cap 22 is adjusted by rotating drive shaft 38 in a selected rotational direction. The position of port 60, 62 and 64 in port block 20 relative to inlet port 30 and outlet port 32 is used to adjust an output pressure from outlet port 32, in known manner. For additional details of the operation of pressure transformer 10, reference is hereby made to PCT Publication No. WO 97/31185, published Aug. 28, 1997. The generally planar abutting surfaces 28 and 58 between end cap 22 and port block 20, as well as the hydrostatic bearing between port block 20 and end cap 22 which is created using hydraulic pressure pads 66–76, greatly simplifies the manufacturing process and reduces manufacturing costs of hydraulic pressure transformer 10.

Other aspects, objects and advantages of this invention can be obtained from a study of the drawings, the disclosure and the appended claims.

What is claimed is:

1. A hydraulic pressure transformer for the conversion of an input hydraulic power to an output hydraulic power, said hydraulic pressure transformer comprising:

a housing including a generally planar face surface and a plurality of ports opening at said face surface;

a barrel rotatable about an axis, said barrel including a generally spherical end face and a plurality of cylinders having respective cylinder ports which open at said end face; and a port block interposed between said barrel and said housing and rotatable about said axis, said port block having a first face surface, a second face surface and a plurality of ports extending between said first face surface and said second face surface, said ports selectively fluidly interconnecting said plurality of cylinder ports in said barrel with said plurality of ports in said housing, said port block includes an annular flange disposed concentrically around said axis and between said first face surface and said second face surface, said flange including a plurality of hydraulic pressure pads, each said hydraulic pressure pad being fluidly connected with at least one of said ports in said port block and opening generally parallel to said axis.

2. The hydraulic pressure transformer of claim 1, wherein in said housing, said first face surface is generally spherical and abuts said end face of said barrel, and second said face surface is generally planar and abuts said face surface of said housing.

3. The hydraulic pressure transformer of claim 1, wherein said flange includes a pair of annular shoulders aligned relative to each other generally parallel to said axis, each said shoulder including a plurality of said hydraulic pressure pads.

4. The hydraulic pressure transformer of claim 3, wherein said plurality of hydraulic pressure pads comprises six hydraulic pressure pads, three of said hydraulic pressure pads located in one of said shoulders and an other three of said hydraulic pressure pads located in an other said shoulder.

5. The hydraulic pressure transformer of claim 4, wherein each said hydraulic pressure pad located in said one shoulder is directly fluidly connected with a respective hydraulic pressure pad located in said other shoulder.

6. The hydraulic pressure transformer of claim 5, wherein said directly fluidly connected hydraulic pressure pads are commonly connected to one of said ports in said port block.

7. The hydraulic pressure transformer of claim 3, wherein said housing includes two annular reaction surfaces respectively disposed adjacent to said pair of annular shoulders.

8. The hydraulic pressure transformer of claim 7, wherein said housing includes an end cap defining said two annular reaction surfaces.

9. The hydraulic pressure transformer of claim 8, wherein said end cap is a two-piece end cap.

10. The hydraulic pressure transformer of claim 2, wherein said housing includes an end cap defining said planar face surface.

11. The hydraulic pressure transformer of claim 1, wherein said plurality of ports in said port block comprises three ports.

* * * * *